US010221527B2

(12) United States Patent
Wilson

(10) Patent No.: US 10,221,527 B2
(45) Date of Patent: Mar. 5, 2019

(54) DRY POLYMER CEMENT OVERLAY FOR TRAFFICKED PAVEMENTS

(71) Applicant: W. Robert Wilson, Mountain Lakes, NJ (US)

(72) Inventor: W. Robert Wilson, Mountain Lakes, NJ (US)

( * ) Notice: Subject to any disclaimer, the term of this patent is extended or adjusted under 35 U.S.C. 154(b) by 0 days.

(21) Appl. No.: 14/811,711

(22) Filed: Jul. 28, 2015

(65) Prior Publication Data

US 2016/0024723 A1 Jan. 28, 2016

Related U.S. Application Data

(60) Provisional application No. 62/030,056, filed on Jul. 28, 2014.

(51) Int. Cl.

| | |
|---|---|
| ***E01C 9/00*** | (2006.01) |
| ***E01C 19/43*** | (2006.01) |
| ***B44F 9/04*** | (2006.01) |

(52) U.S. Cl.

CPC ..... *E01C 9/001* (2013.01); *B44F 9/04* (2013.01); *E01C 9/002* (2013.01); *E01C 19/43* (2013.01)

(58) Field of Classification Search

CPC ..... E01C 9/001; E01C 19/43

See application file for complete search history.

(56) References Cited

U.S. PATENT DOCUMENTS

| | | | | | |
|---|---|---|---|---|---|
| 2,050,299 | A * | 8/1936 | Evers | B28B 7/241 | 249/115 |
| 2,110,335 | A * | 3/1938 | Kritzer | E04F 13/147 | 101/127 |
| 3,406,618 | A * | 10/1968 | Bowman | E01C 9/001 | 404/72 |
| 3,712,825 | A * | 1/1973 | Yocum | B28B 1/16 | 425/811 |
| 4,055,322 | A * | 10/1977 | Cassidy | B28B 7/362 | 249/112 |
| 5,169,573 | A * | 12/1992 | Tsuchida | B29C 39/10 | 264/246 |
| 5,447,752 | A * | 9/1995 | Cobb | E01C 19/43 | 264/31 |

(Continued)

*Primary Examiner* — Abigail A Risic

(74) *Attorney, Agent, or Firm* — Douglas J. Ryder; Ryder, Mazzeo & Konieczny LLC

(57) ABSTRACT

A dry polymer cement overlay for trafficked pavement substrates (both asphalt and concrete). The dry polymer cement overlay is a thin overlay that can handle the load of traffic in a relatively short time and has a relatively long life cycle. Moreover, the dry polymer cement overlay can hold aggregate that is applied on the surface of dry polymer cement overlay before it cures in order to provide a friction surface. A stencil is used during application of a dry polymer cement layer to provide a patterned overlay that includes patterns separated by gullies. The patterned dry polymer cement overlay exhibits improved performance including short and long term substrate adhesion, reduced risk of delamination, safety through improved surface runoff and enhanced visibility, improved macro and micro friction, reflective crack management, and withstands higher deflections under heavy loads. The patterned dry polymer cement overlay may also reduce noise and improve aesthetics.

26 Claims, 5 Drawing Sheets

(56) References Cited

U.S. PATENT DOCUMENTS 5,487,526 A * 1/1996 Hupp ..... B28B 7/24 249/129
5,494,372 A * 2/1996 Oliver ..... B44F 9/04 404/72
6,610,224 B2 * 8/2003 Sullivan ..... B28B 1/16 106/737
7,238,406 B2 * 7/2007 Peterson ..... B44D 2/007 249/112
7,622,155 B1 * 11/2009 Pace ..... B44C 1/24 427/356
7,714,058 B2 5/2010 Wilson
8,153,046 B2 * 4/2012 McCary ..... E04B 2/8635 249/33
8,672,580 B1 * 3/2014 Garceau ..... E01C 19/508 404/75
8,784,557 B2 7/2014 Reck
8,864,409 B2 * 10/2014 Parker ..... E01C 19/43 404/75
9,045,868 B2 * 6/2015 Farrell ..... E01C 19/43
9,267,284 B2 * 2/2016 Shaw ..... E04F 15/12
2002/0076278 A1 * 6/2002 Ross ..... E01C 9/001 404/75
2003/0103810 A1 * 6/2003 Wiley ..... E01C 19/43 404/75
2007/0164484 A1 * 7/2007 Piccolo ..... B28B 7/0026 264/333
2008/0171155 A1 * 7/2008 Haupt ..... B41M 5/0029 428/29
2009/0271933 A1 * 11/2009 Shah ..... C09B 67/0069 8/562
2010/0153311 A1 * 6/2010 McCormick ..... G09F 19/22 705/500
2013/0315666 A1 * 11/2013 Baumgartner ..... E01C 11/00 404/75
2014/0169880 A1 * 6/2014 Parker ..... E01C 19/43 404/77
2015/0191398 A1 * 7/2015 Pucel ..... C04B 41/009 427/259

* cited by examiner

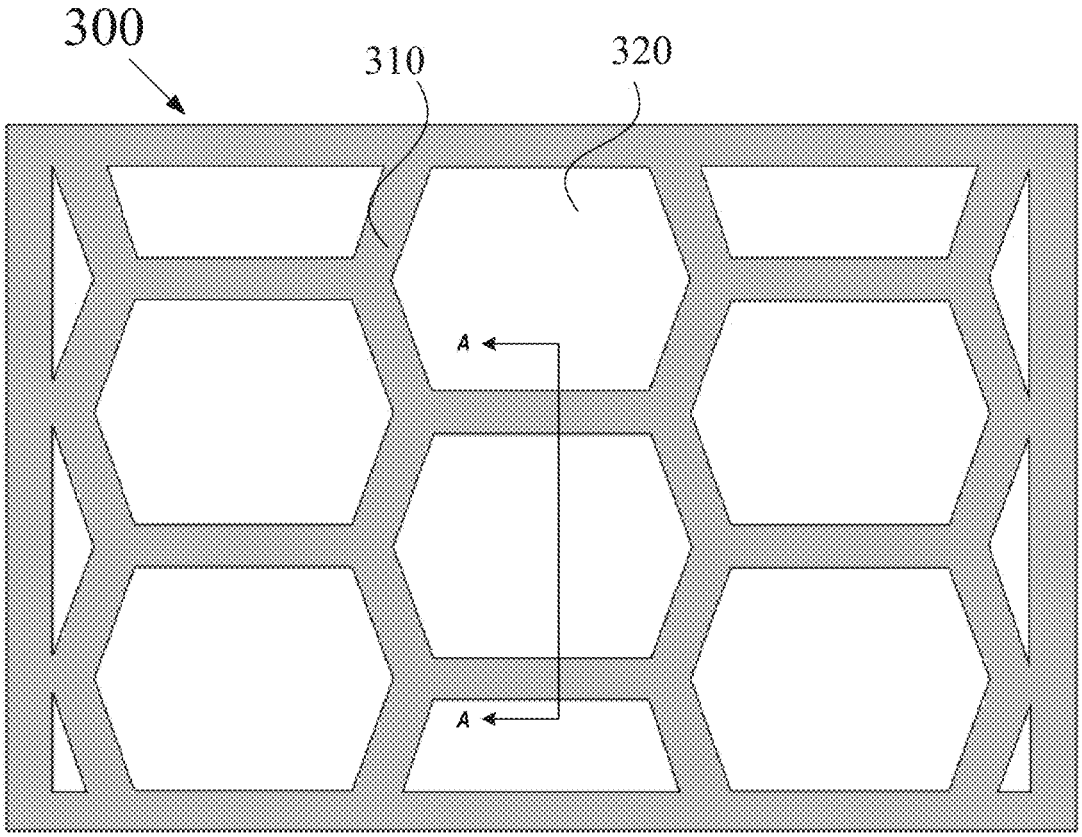
FIG. 3A
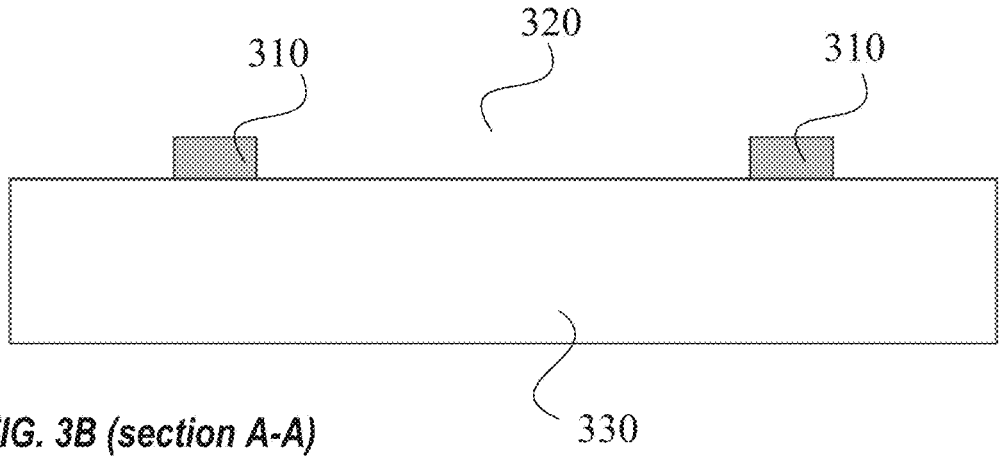
FIG. 3B (section A-A)

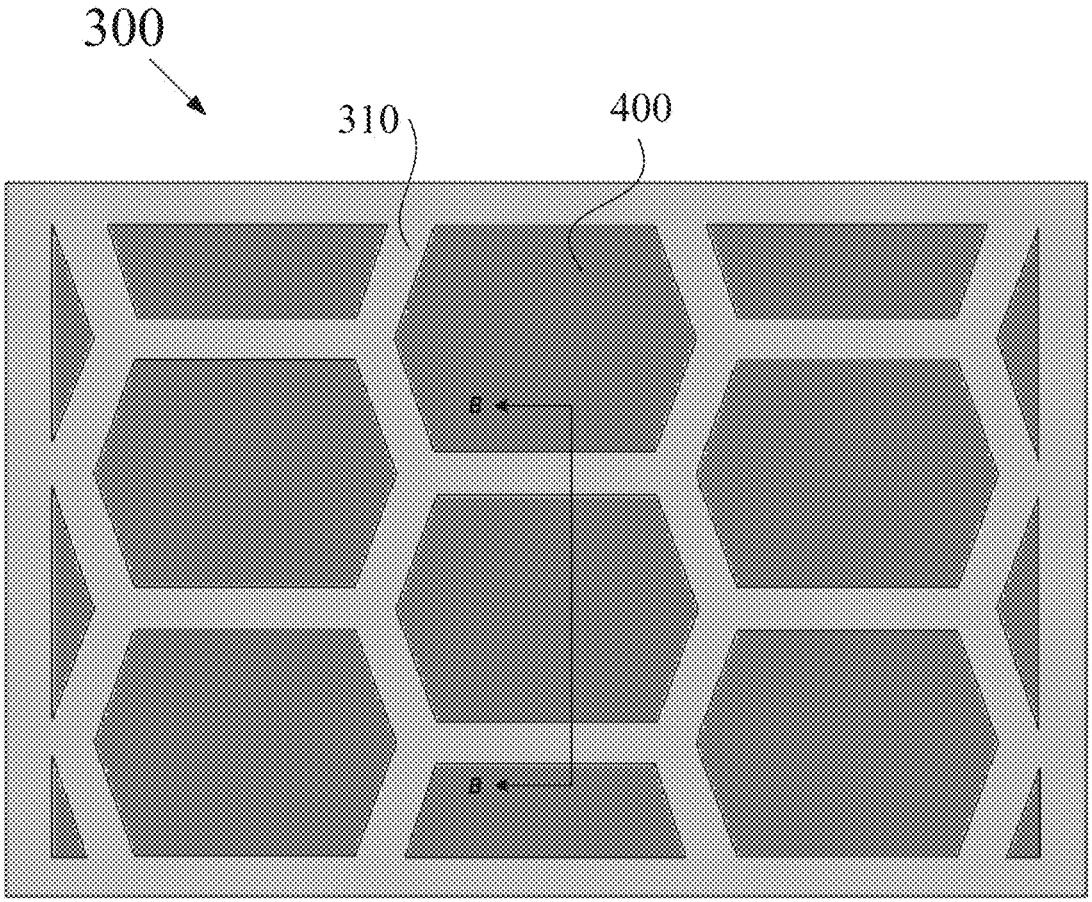
FIG. 4A
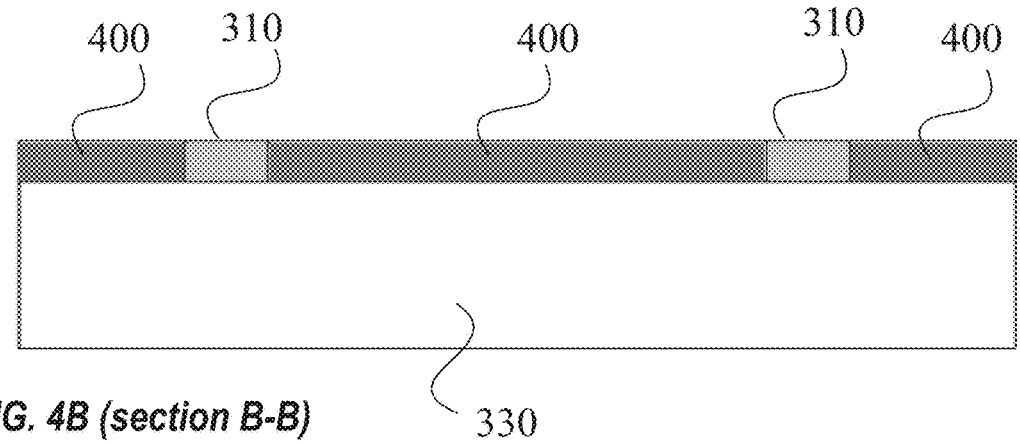
FIG. 4B (section B-B)

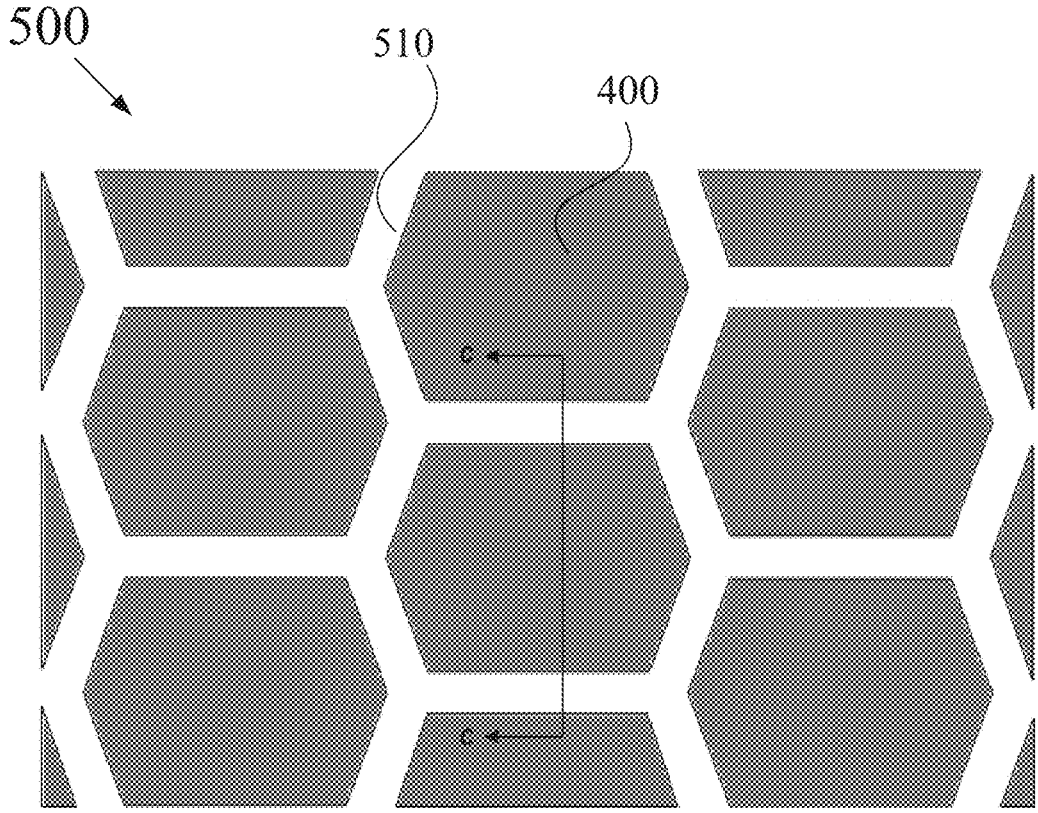
FIG. 5A
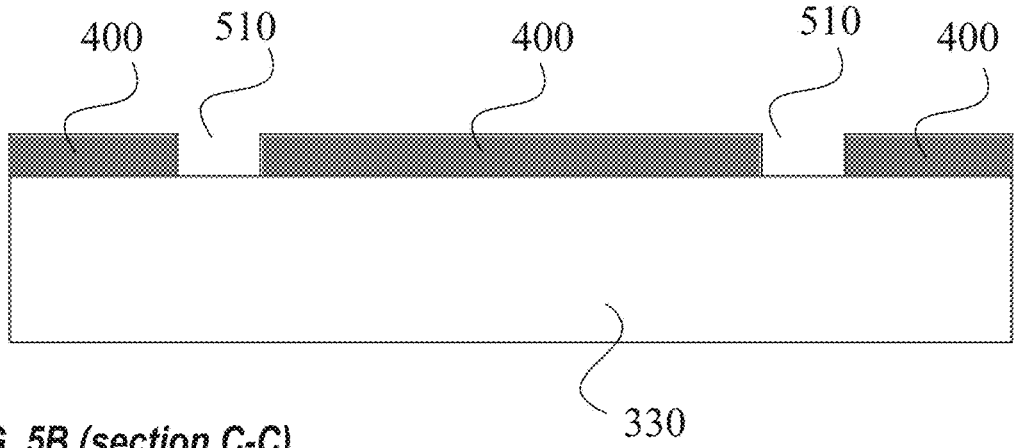
FIG. 5B (section C-C)

DRY POLYMER CEMENT OVERLAY FOR TRAFFICKED PAVEMENTS

BACKGROUND

Pavement surfaces, such as asphalt and concrete, are used to carry traffic, including vehicles (e.g., automobiles, bikes, construction equipment) and humans. Pavement surfaces may need to be marked for various reasons (e.g., divide lanes, identify different areas, provide directions, aesthetics). Pavement surfaces may be marked with paints, or different color polymer coatings (e.g., epoxy), but these markings often do not last a long time because they fade and/or wear off from the traffic riding thereon and/or exposure to ultraviolet (UV) light.

In addition to marking the pavement surface, pavement surfaces may need additional friction on portions thereof (e.g., sections with cornering, sections where braking is required) to increase the safety of the traffic traveling thereon. The additional friction may be provided by placing an overlay on the underlying pavement surface (substrate). The overlay may be provided by applying (overlaying) a wet polymer layer (e.g., epoxy) on the substrate and then applying aggregate onto the wet polymer layer prior to the polymer layer curing. The polymer layer may break down over time due to, for example, continued exposure to UV light. Furthermore, the polymer layer may be thermally incompatible with the pavement surface which may result in delamination of the epoxy from the pavement surface or damage to the pavement surface.

Polymer cements have also been used as the overlay material that provides friction on trafficked pavement surfaces. Polymer cements can also be produced in different colors for delineation and demarcation, and are able to receive traffic and are durable on their own. However, the polymers utilized in these materials are typically acrylic latex polymers (wet polymers) which result in high air voids within the polymer cement. The air voids lead to the polymer cement being porous which enables water to reach the underlying pavement surface without a means of escape. Furthermore, the air voids result in the polymer cement layer being more susceptible to freeze thaw, wear, abrasion and friction loss. Moreover, the use of wet polymers may result in a thin polymer layer forming on the surface and depending on the temperature and humidity during installation may have accelerated curing compared to the rest of the polymer cement layer which commonly results in surface tension cracks.

BRIEF DESCRIPTION OF THE DRAWINGS

The features and advantages of the various embodiments will become apparent from the following detailed description in which:

FIG. 3A illustrates a top view of an example stencil that may be placed over a substrate to create an overlay with non-directional gullies, according to one embodiment;

FIG. 3B illustrates a cross sectional view of the example stencil placed on the substrate, according to one embodiment;

FIG. 4A illustrates a top view of the example stencil after application of a dry polymer concrete layer, according to one embodiment;

FIG. 4B illustrates a cross sectional view of the example substrate showing the dry polymer patterns between the lines of the stencil, according to one embodiment;

FIG. 5A illustrates a top view of the substrate after the example stencil has been removed, according to one embodiment; and FIG. 5B illustrates a cross sectional view of the example substrate showing the dry polymer patterns separated by the gullies, according to one embodiment.

DETAILED DESCRIPTION

Figure 1:
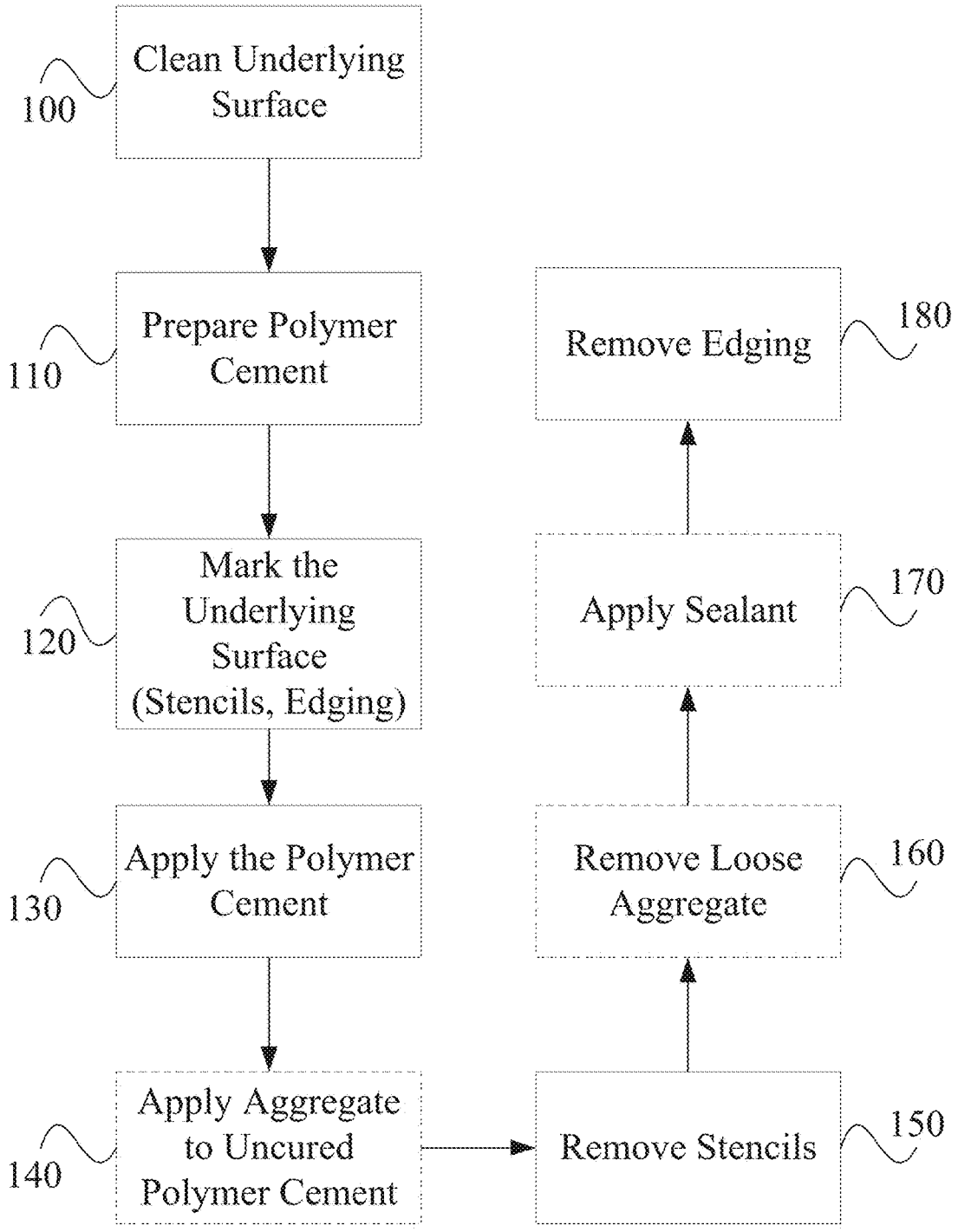
FIG. 1 illustrates an example flow chart for providing a stenciled overlay for use as a pavement surface, according to one embodiment.

The air void and thin polymer layer issues associated with wet polymer cements described above may be resolved by using polymer powders (dry polymers). Dry polymers do not rewet which reduces air voids that are created within the dry polymer cement layer. Dry polymers may also improve adhesion to the underlying pavement surface (substrate), as well as improve the mix workability and flexibility of the cured dry polymer cement layer. Furthermore, the dry polymer cements may cure and be available for traffic in a relatively short amount of time.

According to one embodiment, the dry polymers may be redispersible binders. According to one embodiment, the redispersible binders may be based on a copolymer of vinyl acetate and ethylene. The use of a dry redispersible polymer improves the quality control during the mixing of the product on site. The dry polymer will allow the blended mixture to be delivered to the site and simply require the addition of water which simplifies the mixing and placing operation on site. The redispersible polymer may also include defoaming and self-leveling properties to assist with the reduction of air during the mixing process that is common with the use of wet polymer cements as noted above. The reduction of air improves the impermeability of the surface mix and increases the abrasion resistance of the cured material.

According to one embodiment, the dry polymer cement may also include aggregate to provide layer thickness, to improve mixing, limit segregation and increase skid resistance. Larger aggregates (e.g., single sizes of 4.75 mm, 6.3 mm) including, but not limited to, granite, bauxite, porcelain or other low absorption—hard aggregates may be added to the dry polymer cements, to provide a naturally forming textured surface for the purpose of providing additional skid resistance.

According to one embodiment, the dry polymer cement may also include microfibers to limit segregation, limit shrinkage, improve workability and limit exothermal generation. The microfibers may be between approximately $1/16^{th}$ of an inch to 1 and ½ inch long.

According to one embodiment, the dry polymer cement may also include a plasticizer to increase workability and accommodate less water to reduce water to cement ratio. According to one embodiment, the dry polymer cement may include an accelerator to increase curing process that may be needed for night time applications and time sensitive applications. According to one embodiment, the dry polymer cement may also include a retarder along with the accelerator to delay the change in workability that comes from adding the accelerator.

According to one embodiment, the dry polymer cement may also include a filler, such as a pozzolanic filler. The filler increases workability, limits segregation and shrinkage and increases long term compressive strength. The filler may be fly ash, such as class C or class F fly ash.

According to one embodiment, the dry polymer cement may be the same or similar to the dry polymer cement overlay described in U.S. Pat. No. 8,784,557 which is herein incorporated by reference. According to one embodiment, the dry polymer cement may use different versions for at least some of the various ingredients described therein (e.g., may use different dry polymers than the Elotex® polymers noted therein), may use different ratios for at least some of the ingredients, may replace certain ingredients, may add ingredients thereto, may delete ingredients therefrom, may use a single ingredient in place of a combination of different ingredients and/or may use a combination of different ingredients instead of a single ingredient. The ingredients and the ratios may depend on the specific application of the dry polymer cement overlay.

According to one embodiment, the dry polymer cement may be Endurablend™ provided by Pavement Surface Coatings, LLC, a New Jersey Corporation.

The dry polymer cement overlay may be applied over both asphaltic and concrete surfaces, including sealcoats; single chip, double chip or cape seals; all asphalt slurry types; all asphalt microsurfacings, thin hot mix flexible asphalt pavement surfaces with high surface deflections (≥0.8 mm deflection); thick hot mix flexible asphalt pavement surfaces with low surface deflections (≤0.8 mm deflection); all Portland cement concrete pavements; roller compacted concrete; and whitetopping.

The overlay may be used for pavement surfaces that are trafficked with, for example, pedestrians, bicycles, passenger vehicles, trucks, aircraft and heavy duty equipment. The overlay may be used to mark the pavements and/or to provide a friction surface.

Dry polymer cements have advantages over the use of wet polymers (e.g., epoxy) or wet polymer cements to produce an overlay. For example, the dry polymer cement layer can be applied as a thin overlay (e.g., between approximately ⅛ and 3/16 inch thick) that can handle the load of traffic in a relatively short time and has a relatively long life cycle. Furthermore, the dry polymer cement layer can provide additional friction and if colored, the color may have a relatively long life cycle. Moreover, the dry polymer cement layer can hold aggregate that is applied on the surface of dry polymer cement layer before it cures in order to provide a friction surface.

However, the dry polymer cement (overlay) still may be thermally incompatible with the underlying pavement surface (both asphalt and concrete). The thermal incompatibility may lead to the layers flexing, expanding and the like at different times and to different degrees. This may cause delamination of the overlay from the underlying pavement surface and/or damage to the overlay and/or underlying pavement surface.

In order to reduce the effect of the thermal incompatibility, the continuous amount of surface area where the two layers overlap may be limited. The limited overlap limits the strain caused from the thermal incompatibility from building up between the two surfaces. Limiting the amount of continuous surface area may be accomplished by patterning the surface layer so that uniform gullies (e.g., grout lines) are located between the patterns. The use of patterns and gullies limits the amount of continuous contact between the two layers to the patterns formed in the overlay. The thermally developed strain that may build up between an overlay pattern and the underlying surface may be relieved at the location of the gullies. Limiting the accumulation of strain may prevent delamination and stress to the underlying surface that can cause cracking and eventually failure of the underlying surface.

A shrinkage crack that develops in the underlying surface, will likely form in the gulley (may be limited to forming in the gulley). Limiting the damage (e.g., cracks) to the underlying surface to within the gullies may prevent future more severe damage to the overlay and thereby failure of the underlying surface. Additionally a crack formed within a gully will not be felt by traffic traversing the riding surface or be visually seen.

The overlay patterns may be formed by using stencils. The stencils may be pre-manufactured to produce the desired pattern shape, size and thickness. The stencils may be made from, for example, paper, metallic materials, plastic, synthetic materials or some combination thereof. The shapes, size and thickness of the patterns (shapes formed within the overlay) may be dictated based on, for example, the look desired and the primary use of the overlay.

For example, a walkway for foot traffic may be made of rectangle size patterns that look like bricks (an aesthetic look). The thickness of the overlay and the patterns formed therein may be based on, for example, the weight of the traffic that will be using the pathway. For example, the thickness of the overlay may increase as the anticipated weight of the traffic increases (thicker overlays may be used to support heavier vehicles, such as construction equipment, while thinner overlays may be used to support lighter vehicles, such as bicycles). Furthermore, the size of the gullies between patterns may be based on the traffic using the overlay. For example, the gullies for bicycle or walking paths may be smaller than the gullies for heavy equipment. Bike tires or feet could get caught in the gullies if the gullies are too large while a large tire would not get caught in a large gulley and a larger gulley may provide more stress relief for heavy traffic conditions.

The use of patterns and gullies provides additional benefits other than stress relief. For example, the gullies provide a means for water run-off and thus reduces the amount of standing water on the riding surface. That is, the water enters the gullies rather than pooling on the riding surface. If the gullies extend to the edge of the overlay, the water may follow the gullies to the end of the overlay and escape therefrom. The reduction of water on the riding surface reduces the amount of water that may spray up as a vehicle traverses the riding surface and also increases the effective friction of the riding surface. This increases the safety of the pathway at times when the overlay may be inundated with water (e.g., during inclement weather such as when it's raining).

Moreover, the patterned overlay may provide noise reduction for traffic tire noise. The gullies may also provide sound reduction by, for example, capturing some of the sound of the traffic (e.g., sound of tires traversing the riding surface) therein and/or reducing the amount of contact between, for example, the tires and the overlay and thus reduce the amount of noise generated.

FIG. 1 illustrates an example flow chart of steps to be taken for providing a thin stenciled overlay (dry polymer cement layer) for use on a pavement surface. As with the application of any overlay, the underlying surface must be prepared 100. The pavement surface should be clean and dry to ensure proper adhesion of the polymer cement materials. All pavement marking materials should be removed, or masked, using an appropriate technique (e.g., shot blasting, high pressure water blasting, grinding). Any loose dust or dirt should be removed. Typically, the loose dust or dirt can be removed with blowers (e.g., industrial blowers). However, if the pavement surface is soil contaminated, then the surface may require pressure washing. Any wet spots, oil spots, dirt, curing compounds and any films should be removed as part of the surface preparation.

During the preparation of the surface, the polymer cement materials may be mixed or prepared in accordance with the manufacturer's recommendations and instructions 110.

The area to be surfaced should be clearly marked out in accordance with the plan (e.g., drawings, engineering instructions) 120. The boundary of the area (e.g., curbs, utility boxes) to be surfaced should be taped using, for example, 6" wide duct tape. The stencils are then placed to produce the desired pattern. The individual stencils may require being attached to each other or the pavement to ensure that they do not move while they are trafficked by the work crews and or due to wind.

Once the stencils cover sufficient area, the polymer cement materials are applied onto the surface covered by the stencils 130. Preferably, the polymer cement materials are sprayed onto the stencils using a spray gun to achieve the same uniform thickness. Alternatively, they can be poured on the surface and squeegeed to form a uniform thickness.

If topically applied aggregate is specified to deliver a high friction surface, then the aggregate is broadcast by hand or by mechanical means onto the uncured surface 140. It should be noted that the application of aggregate to provide additional friction may not be required/desired for every application and is therefore an optional step that is illustrated as a dashed box. Topically applied aggregates (e.g., single size of 2.65 mm, 4.75 mm, 6.3 mm) including, but not limited to, bauxite, crushed granite and slag may be used to provide the high friction surface. Depending on the size of the aggregate specified, a light roller might be required to seat the aggregate in the polymer cement material. The type of topical aggregate utilized may be based on the use of the pavement surface. Different aggregates may be utilized in different portions of the patterned polymer cement layer if different degrees of friction are required.

The stencils are removed once the dry polymer cement has cured to a point when the stenciled pattern can maintain its shape integrity to allow defined gullies to promote water runoff and substrate strain relief paths 150. The stencil can be re-used to continue the operation depending on the staging requirements. Any masking or edging tape should be removed immediately after the stencils to ensure sharp edges.

After the material is cured, any loose aggregate is then removed by, for example, using hand held brooms, or by a mechanical broom, or by using a vacuum truck 160. As the application of aggregate may not be utilized for every application the removal of excess aggregate may not be required/desired and is therefore an optional step that is illustrated as dashed box.

Where appropriate, or where specified, a curing agent or sealant should be applied after the material has cured 170. The curing agent or sealant should be spray applied, and then to ensure uniform coverage, a roller should be used to spread the sealant uniformly. It should be noted that the application of a curing agent/sealant may not be required/desired for every application and is therefore an optional step that is illustrated as dashed box.

Once the curing agent or sealant has fully cured, then the edging can be removed and traffic can then be allowed onto the surface 180.

It should be noted that the example flow chart is not intended to limit the steps required to form a patterned polymer cement overlay for traffic to those defined or to the order defined. Rather, steps may be added, deleted, combined, separated and/or the order of the steps may be modified without departing from the scope of the current invention. The invention is intended to cover the various manners in which a patterned dry polymer concrete layer may be formed on a traffic surface where the overlaying layer will be used to handle traffic.

Figure 2:
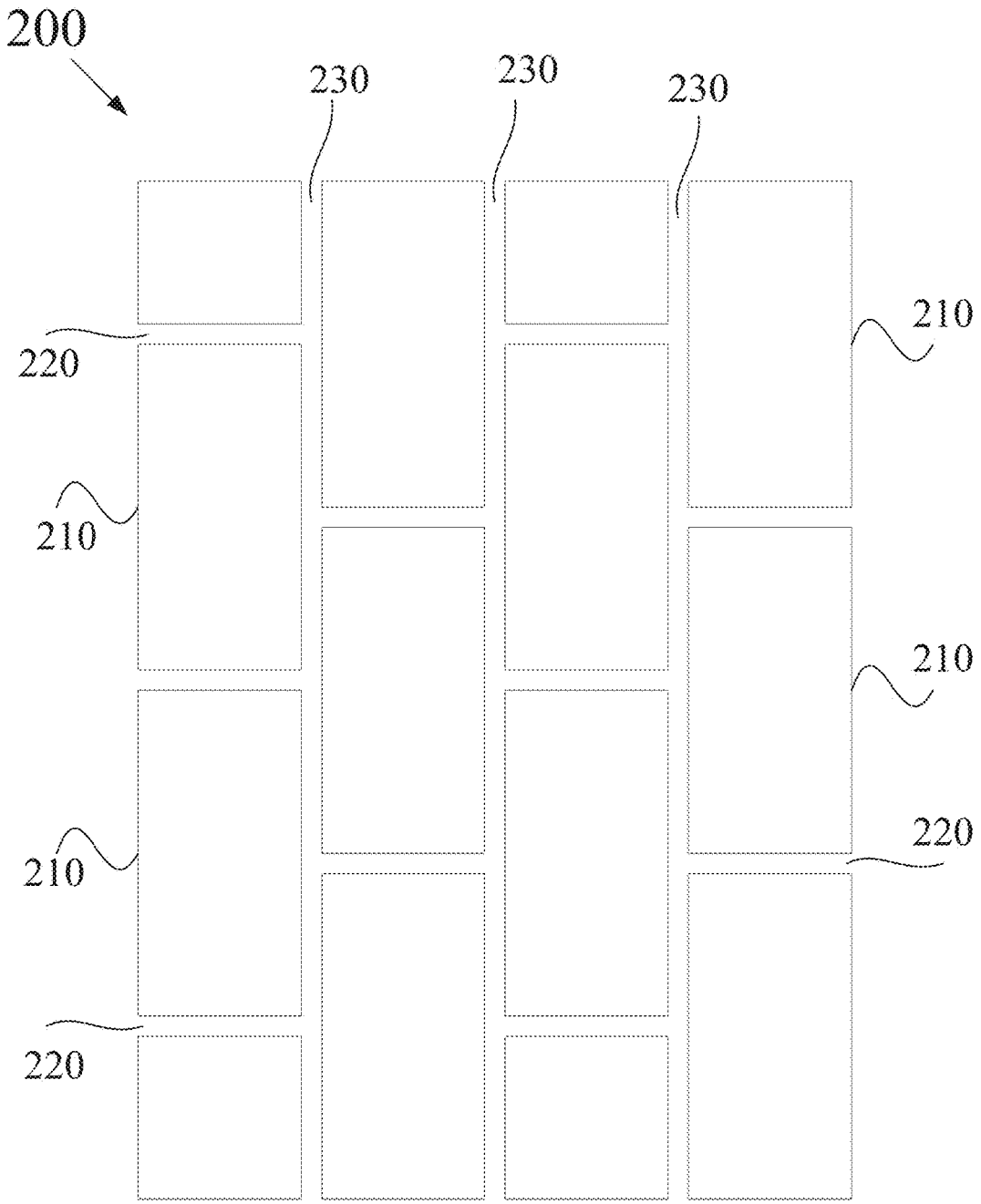
FIG. 2 illustrates an example overlay with rectangle patterns formed therein creating an extended gulley, according to one embodiment.

Using certain patterns (e.g., squares, rectangles) may result in either the tops and bottoms or the sides of successive patterns being aligned. This results in an extended gulley formed in the overlaying surface. FIG. 2 illustrates an example overlay 200 with rectangle patterns 210 formed therein (only a subset of the patterns are illustrated with reference numbers for ease of illustration). As illustrated, the rectangle patterns are aligned in columns but not in rows (the placement of the rectangles from column to column are staggered). Accordingly, the gullies formed horizontally 220 (only a subset of the horizontal gullies are illustrated with reference numbers for ease of illustration) only extend the width of one pattern (rectangle) while the gullies that extend vertically 230 extend the length of the overlay 200. As the vertical gullies 230 extend over a large area, cracks formed in the underlying surface may extend between patterns and may extend over a large area.

In addition to the formation of extended gullies, the use of rectangles 210 as the pattern presents an overlay 200 in which the spacing of the gullies is different based on direction. For example, the distance between gullies from side to side is much smaller than the distance between gullies from top to bottom. Such a configuration may result in a different feel and/or different sound based on the direction in which the riding surface is traversed.

According to one embodiment, the shapes utilized for the patterns may prevent the gullies from aligning together to form a long gulley that may create an extended stress line and/or result in different spacing of gullies based on direction the riding surface is being traversed. That is, the patterns utilized may form non-directional gullies. Effective patterns may have multiple sides that will result in gullies not traversing the same path when placed side by side. For example, hexagons and/or octagons may result in non-directional gullies that do not extend further than a side of one pattern.

It should be noted that patterns utilized for forming non-directional gullies result in additional gullies being formed. For example, a hexagon pattern results in formation of six gullies while a square or rectangle pattern results in only four gullies. These extra gullies may provide additional area for water run-off which may result in a better friction surface. Furthermore, the additional gulley area (reduced overlay surface area) may also result in increased sound reduction or may reduce the sound created as the riding surface is traversed.

FIG. 3A illustrates a top view of an example stencil 300 that may be placed over a substrate (underlying pavement surface) to create an overlay with non-directional gullies. As illustrated, the stencil 300 includes lines 310 surrounding hexagon patterns 320. Only a subset of the lines 310 and patterns 320 are illustrated with reference numbers for ease of illustration. The lines 310 (which is where the gullies will be formed between the patterns as the polymer concrete will not be located there) do not traverse is the same direction for more than one pattern (hexagon) 320. At the end of each pattern 320 the lines 310 switch direction at a 120 degree angle associated with hexagons.

FIG. 3B illustrates a cross sectional view of the example stencil 300 placed on the substrate 330. The lines 310 of the stencils are located on top of the substrate 330 and the patterns 320 are formed between a plurality of lines 310. It should be noted that while the pattern 320 is labeled between the two lines 310 for ease of illustration, the actual pattern would not be visible from this view.

FIG. 4A illustrates a top view of the example stencil 300 after application of a dry polymer concrete overlay so that the patterns are now dry polymer patterns 400. FIG. 4B illustrates a cross sectional view of the example substrate 330 showing the dry polymer patterns 400 between the lines 310.

FIG. 5A illustrates a top view of the substrate 330 after the stencil 300 has been removed leaving a patterned overlay 500. The patterned overlay 500 includes a plurality of dry polymer patterns 400 separated by a plurality of gullies 510. FIG. 5B illustrates a cross sectional view of the example substrate 330 showing the dry polymer patterns 400 separated by the gullies 510.

The dry polymer cement layer may be colored different colors depending on the use of the overlaying layer. For example, cross walks may be colored red, bike paths green, and dividing lines yellow. If the pathway requires multiple colors a first color will be applied and then the first color will be masked when the second color is applied. For example, the yellow stripes in a roadway may be applied first and then they may be masked when the rest of the roadway is applied.

While the invention has been described with respect to dry polymer concrete layers it may also be applicable to other types of layers that may be applied as a thin overlay that cures in a relatively short amount of time and can support the necessary traffic. These layers may also be capable of receiving a surface aggregate and being formed into patterns separated by gullies by utilizing a stencil during application.

Although the invention has been illustrated by reference to specific embodiments, it will be apparent that the invention is not limited thereto as various changes and modifications may be made thereto without departing from the scope. Reference to "one embodiment" or "an embodiment" means that a particular feature, structure or characteristic described therein is included in at least one embodiment. Thus, the appearances of the phrase "in one embodiment" or "in an embodiment" appearing in various places throughout the specification are not necessarily all referring to the same embodiment.

The various embodiments are intended to be protected broadly within the spirit and scope of the appended claims.

The invention claimed is:

1. A method for providing a dry polymer cement as a thin patterned overlay directly on a trafficked pavement substrate, wherein the trafficked pavement substrate is to enable a plurality of vehicles to traverse thereover on a consistent basis, wherein the trafficked pavement substrate can be either a concrete surface or an asphalt surface, the method comprising:

cleaning the trafficked pavement substrate;

securing a stencil to the trafficked pavement substrate, wherein the stencil forms a plurality of patterns;

preparing the dry polymer cement by adding water to a blended mixture, wherein the blended mixture includes cement, aggregate, microfibers and polymer powders;

applying the dry polymer cement directly onto the trafficked pavement substrate having the stencil secured thereto as a thin layer; and removing the stencil after the thin layer of the dry polymer cement has cured, wherein once the stencil is removed the thin patterned overlay is formed, wherein the thin patterned overlay includes a plurality of patterns separated by a plurality of gullies, and wherein the thin patterned overlay can handle the plurality of vehicles that traverse the trafficked pavement substrate on a consistent basis.

2. The method of claim 1, wherein the microfibers have a length between approximately $1/16^{th}$ of an inch to 1½ inch.

3. The method of claim 1, wherein the blended mixture further includes a plasticizer and a retarder.

4. The method of claim 1, wherein the applying the dry polymer cement includes spraying the dry polymer cement onto the trafficked pavement substrate as the thin layer.

5. The method of claim 1, further comprising applying a topical aggregate to the thin layer of the dry polymer cement prior to the thin layer of the dry polymer cement curing, wherein the topical aggregate can be traversed by the plurality of vehicles and is to provide a friction surface for the plurality of vehicles traversing the trafficked pavement substrate.

6. The method of claim 1, wherein continuous contact between the thin layer of dry polymer cement and the trafficked pavement substrate is limited by the patterns and the gullies and therefore reduces likelihood of delamination of the thin layer of dry polymer cement from the trafficked pavement substrate or damage to the trafficked pavement substrate caused by thermal incompatibility thereof.

7. The method of claim 1, wherein the gullies enable water to enter therein and be discharged therefrom in order to avoid water pooling and thus reduce spray, and increase friction during a rainfall event.

8. The method of claim 1, wherein the thin patterned overlay reduces noise generated by traffic traversing the trafficked pavement substrate.

9. The method of claim 1, wherein the stencil forms patterns that result in non-directional gullies.

10. The method of claim 1, wherein the patterns are hexagons.

11. A thin patterned overlay provided directly on a trafficked pavement substrate, wherein the trafficked pavement substrate is to enable a plurality of vehicles to traverse thereover on a consistent basis, wherein the trafficked pavement substrate can be either a concrete surface or an asphalt surface, the overlay comprising:

a dry polymer cement formed by adding water to a blended mixture, wherein the blended mixture includes cement, aggregate, microfibers and polymer powders, wherein the dry polymer cement is patterned into a plurality of patterns separated by a plurality of gullies when applied directly to the trafficked pavement substrate having stencils secured thereto to form the thin patterned overlay, wherein continuous contact between the dry polymer cement and the trafficked pavement substrate is limited by the patterns and the gullies and therefore reduces likelihood of delamination of the dry polymer cement from the trafficked pavement substrate or damage to the trafficked pavement substrate caused by thermal incompatibility thereof, wherein the thin patterned overlay can handle the plurality of vehicles that traverse the trafficked pavement substrate on a consistent basis.

12. The overlay of claim 11, wherein the gullies are to enable water to enter therein and be discharged therefrom in order to avoid water pooling and thus reduce spray, and increase friction during a rainfall event.

13. The overlay of claim 11, wherein the plurality of patterns separated by the plurality of gullies are to reduce noise generated by traffic traversing the trafficked pavement substrate.

14. The overlay of claim 11, wherein the microfibers have a length between approximately $1/16^{th}$ of an inch to 1½ inch.

15. The overlay of claim 11, wherein the gullies are non-directional gullies that do not extend in the same direction from one pattern to another.

16. The overlay of claim 11, wherein the patterns are hexagons.

17. The overlay of claim 11, further comprising a surface aggregate applied to the dry polymer cement prior to the dry polymer cement curing, wherein the surface aggregate can be traversed by the plurality of vehicles and is to provide a friction surface for the plurality of vehicles traversing the trafficked pavement substrate.

18. A method for providing a dry polymer cement as a friction providing thin overlay directly on a trafficked pavement substrate, wherein the trafficked pavement substrate is to enable a plurality of vehicles to traverse thereover on a consistent basis, wherein the trafficked pavement substrate can be either a concrete surface or an asphalt surface, the method comprising:

cleaning the trafficked pavement substrate;

preparing the dry polymer cement by adding water to a blended mixture, wherein the blended mixture includes cement, aggregate, micro fibers and polymer powders;

applying the dry polymer cement directly onto the trafficked pavement substrate as a thin layer; and applying surface aggregate to the thin layer of dry polymer cement prior to the thin layer of dry polymer cement curing, wherein the surface aggregate in the thin layer of dry polymer cement forms the friction providing thin overlay, wherein the friction providing thin overlay can be traversed by the plurality of vehicles and is to provide a friction surface for the plurality of vehicles traversing the trafficked pavement substrate.

19. The method of claim 18, wherein the micro fibers have a length between approximately $1/16^{th}$ of an inch to 1½ inch.

20. The method of claim 18, wherein the applying the dry polymer cement includes spraying the dry polymer cement onto the trafficked pavement substrate as the thin layer.

21. The method of claim 18, further comprising securing a stencil to the trafficked pavement substrate prior to the applying the dry polymer cement, wherein the stencil forms a plurality of patterns; and removing the stencil after the dry polymer cement layer has cured, wherein once the stencil is removed a thin patterned overlay is formed, wherein the thin patterned overlay includes a plurality of patterns separated by a plurality of gullies.

22. The method of claim 21, wherein the stencil forms patterns that result in non-directional gullies.

23. The method of claim 21, wherein the patterns are hexagons.

24. The method of claim 18, wherein the trafficked pavement substrate is asphalt.

25. The overlay of claim 11, wherein the trafficked pavement substrate is asphalt.

26. The method of claim 1, wherein the trafficked pavement substrate is asphalt.

* * * * *